United States Patent [19]

Kashiwara et al.

[11] Patent Number: 4,851,732

[45] Date of Patent: Jul. 25, 1989

[54] SPARK PLUG HAVING A FLAME DEFLECTOR FOR USE IN AN INTERNAL COMBUSTION ENGINE

[76] Inventors: Takeaki Kashiwara, 37-411, 3, Nagayoshidedo 3-chome, Osaka; Ryohei Kashiwara, Nishimura Building No. 302, 85-6 Ootori Nishimachi 1-cho, Sakai; Hideaki Kashiwara, 611, 3-B, 151-30, Mukojima Ninomaru-cho, Fushimi-ku, Kyoto-shi, all of Japan

[21] Appl. No.: 108,894

[22] Filed: Oct. 15, 1987

[30] Foreign Application Priority Data

Oct. 27, 1986 [JP] Japan ..... 61-256573

[51] Int. Cl.[4] ..... H01T 13/32; H01T 13/54

[52] U.S. Cl. ..... 313/141; 313/143; 123/169 EL

[58] Field of Search ..... 313/122, 125, 138, 139, 313/140, 141, 143; 123/169 EL, 169 EB, 169 MG

[56] References Cited

U.S. PATENT DOCUMENTS

| | | | |
|---|---|---|---|
| 1,360,294 | 11/1920 | Hill | 313/139 X |
| 1,371,488 | 3/1921 | Jacobson | 313/139 |
| 2,129,003 | 9/1938 | Grant | 123/169 |
| 2,391,459 | 12/1945 | Hensel | 123/169 |
| 2,616,407 | 11/1952 | Thomas | 123/169 |
| 2,944,178 | 7/1960 | Schaub | 313/141 |
| 3,313,972 | 4/1967 | Beesch | 313/140 X |
| 3,970,885 | 7/1976 | Kasima | 313/141 |
| 4,023,058 | 5/1977 | Lara et al. | 313/139 |
| 4,123,998 | 11/1978 | Heintzelman | 313/143 X |
| 4,401,915 | 8/1983 | Kashiwara et al. | 313/142 |

FOREIGN PATENT DOCUMENTS

| | | |
|---|---|---|
| 2479588 | 2/1981 | France . |
| 53-87331 | 4/1978 | Japan . |
| 53-121107 | 6/1978 | Japan . |
| 53-25743 | 10/1978 | Japan . |
| 53-54774 | 11/1978 | Japan . |
| 61-30394 | 10/1986 | Japan . |
| 187501 | 10/1922 | United Kingdom . |

*Primary Examiner*—Kenneth Wieder

*Attorney, Agent, or Firm*—Fisher, Christen & Sabol

[57] ABSTRACT

A spark plug is provided with a plurality a flame deflecting plates depending from the housing of the plug to define a combustion chamber proximate to the electrodes of the spark plug. The plates may be radially disposed to direct combustion gases radially outward or angled to provide a spiralling motion to the combustion gases. An alternative embodiment provides a sleeve having the flame deflector plates depending axially therefrom in a similar fashion. A spark plug is threaded to internal threads of the sleeve such that the deflector plates are proximate to the electrodes of the spark plug.

31 Claims, 12 Drawing Sheets

SPARK PLUG HAVING A FLAME DEFLECTOR FOR USE IN AN INTERNAL COMBUSTION ENGINE

This invention relates to an ignition plug for use in an internal combustion engine for motor cars and the like of which the combustion speed is increased so widely as to improve fuel economy greatly.

As having disclosed in Japanese Patent Publication No. 61-30394 U.S. Pat. No. 4,401,915 and others, the inventors completed an ignition plug for causing an instantaneous combustion by providing to a grounded electrode a plurality of holes at an interval or a long narrow hole in the longitudinal direction thereof or further providing thereto hollow slopes open to the piston side down from the holes/hole so that combustion gas can flow easily from spark gap to the piston side. In such an ignition plug, the combustion time on the piston side can certainly be reduced widely by igniting air-gas mixture (hereinafter simply referred to as gas mixture) collected in a cavity under the hollow grounded electrode, but the problems are that early combustion on the spark side is not expected like on the piston side, i.e. the combustion on the spark side tends to lag behind and a turbulent action of the combustion gas, as well as a high combustion speed thereof, is not similarly expected from every internal combustion engine with various piston displacement.

Under the circumstances, the inventors made intensive studies to eliminate these drawbacks inherent to the prior art and finally accomplished this invention.

Accordingly, it is an object of this invention to provide an ignition plug capable of causing uniform instant combustion in a combustion chamber. It is another object of this invention to provide an ignition plug capable of reducing the energy loss in the progress of compression and improving the engine efficiency by reducing the combustion time. It is still another object of this invention to provide an ignition plug capable of simply controlling the combustion-preventing action of a grounded electrode and increasing the turbulent action similarly in any combustion chamber by providing a plurality of guide plates different in shape and arrangement in the surrounding of a spark gap.

The above and other objects and features of this invention will appear more fully hereinafter from a consideration of the following description taken in connection with the accompanying drawings wherein limited number of examples are illustrated by way of example.

This invention concerns an ignition plug for use in an internal combustion engine, characterized in that a grounded electroconductive cylinder is fitted on an insulating cover on a center electrode and the end brim of said grounded electroconductive cylinder is provided with a grounded electrode of which the free end opposes said center electrode with spark gap put in between and a plurality of plates in such a way that said plates are arranged on the same circumference around said center electrode at an almost equal interval dividing a space surrounding a spark gap.

Also, this invention concerns an ignition plug for use in an internal combustion engine, characterized in that a grounded electroconductive cylinder is fitted on an insulating cover on a center electrode, the end brim of said grounded electroconductive cylinder is provided with a grounded electrode of which the free end opposes said center electrode with spark gap put in between, an electroconductive socket is detachably fitted on said grounded electroconductive cylinder with thread and the end brim of said electroconductive socket is provided with a plurality of plates in such a way that said plates are arranged on the same circumference around said center electrode at an almost equal interval dividing a space surrounding a spark gap so that similar types of sockets with different types of plates can be replaced interchangeably.

Such is the structure of the plug of this invention that when sparks form in the spark gap, seeds of gas mixture in the space surrounded by the plates are ignited, which puts a small amount of gas mixture between adjacent plates on fire in a moment. Combustion gas thus produced expands radially and perpendicular to the axial line of the center electrode, impinging on the plates and the formation of ignited seeds is prompted, as well as the combustion speed is increased. In this way, gas mixture can be instantly put on fire on both the piston and the spark sides, unlike in a conventional ignition plug in which unevenness is predominant in terms of combustion speed. In consequence, gas mixture in the surroundings of the plates uniformly ignites, which reduces the combustion time, minimizes the energy loss in the progress of piston compression and results in the increase of the engine efficiency.

Moreover, according to the second claim of this invention, a metal cylinder with a grounded electrode and a socket with plates can be manufactured separately so that they can engage with each other, with the result that the combustion-preventing action generally more or less recognizable in common electrode can be simply controlled by adjusting their mutual positions; additionally, the shape of the plates can be changed from plug to plug according to the circumstances, as well as their inclination to the radial direction of a center electrode; therefore, the turbulent action and direction of combustion gas can be adjusted in various ways, if necessary. Similar kinds of sockets with different types of plates can be interchangeably used according to the piston displacement, so that the performance of an internal combustion engine can be brought about to the full with various kinds of fuels, in combination with different types of grounded electrodes attached to a metal cylinder.

FIGS. 1 to 3 show the first example of a plug of this invention, wherein FIG. 1 is a cross-sectional general view thereof, FIG. 2 is a cross-sectional view of an essential part thereof and FIG. 3 is a bottom view thereof.

FIGS. 4 to 6 show a modification of the plug in the first example, wherein FIG. 4 is a cross-sectional general view thereof, FIG. 5 is a cross-sectional view of an essential part thereof and FIG. 6 is a bottom view thereof.

FIGS. 7 to 9 show the second example of a plug of this invention, wherein FIG. 7 is a cross-sectional view of an essential part thereof, FIG. 8 is a bottom view thereof and FIG. 9 is a transversal cross-sectional view of a grounded electrode.

FIGS. 10 to 12 show a modification of the plug in the second example, wherein FIG. 10 is a cross-sectional view of an essential part thereof, FIG. 11 is a bottom view of thereof and FIG. 12 is a transversal cross-sectional view of a grounded electrode.

Figure 13:
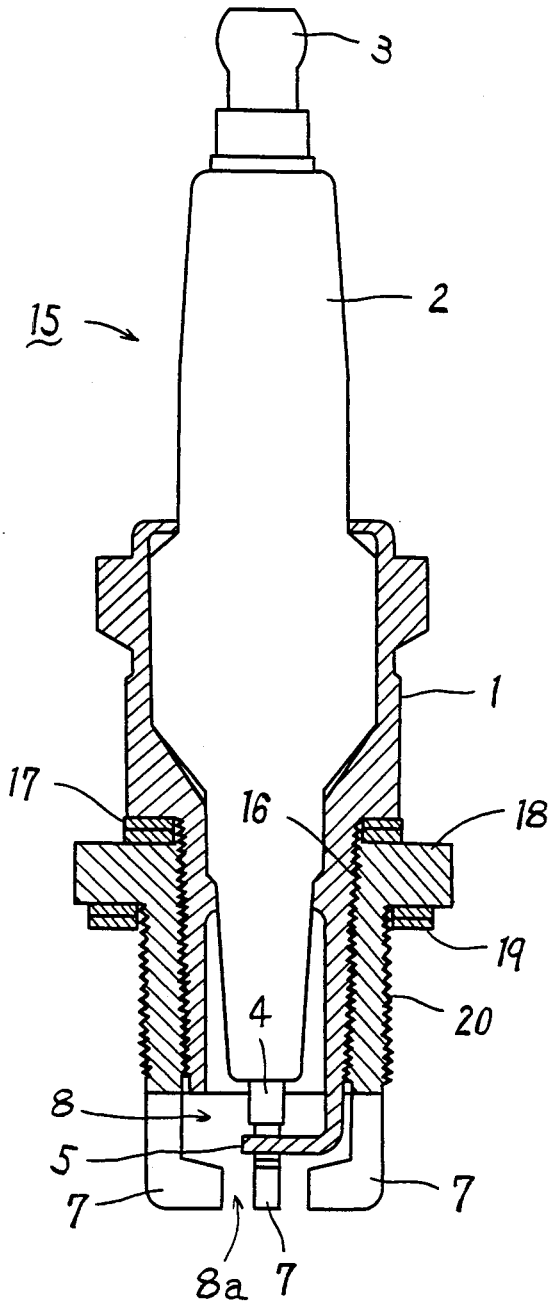
Figure 14:
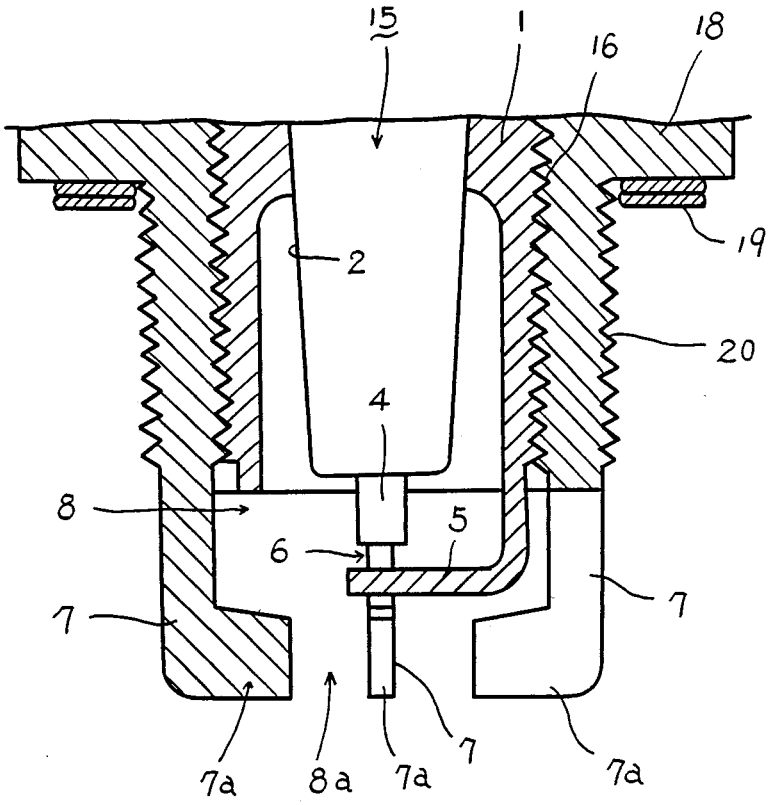
Figure 15:
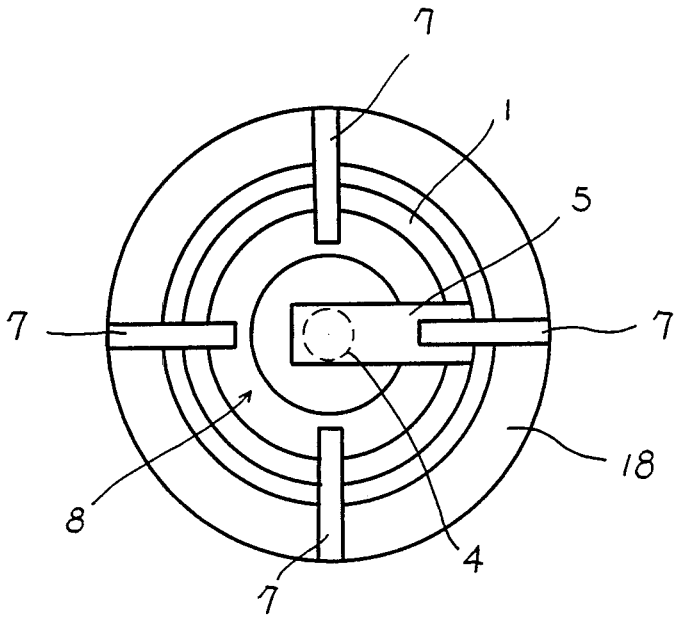

FIGS. 13 to 15 the third example of a plug of this invention, wherein FIG. 13 is a cross-sectional general view thereof, FIG. 14 is a cross-sectional view of an essential part thereof and FIG. 15 is a bottom view thereof.

Figure 16:
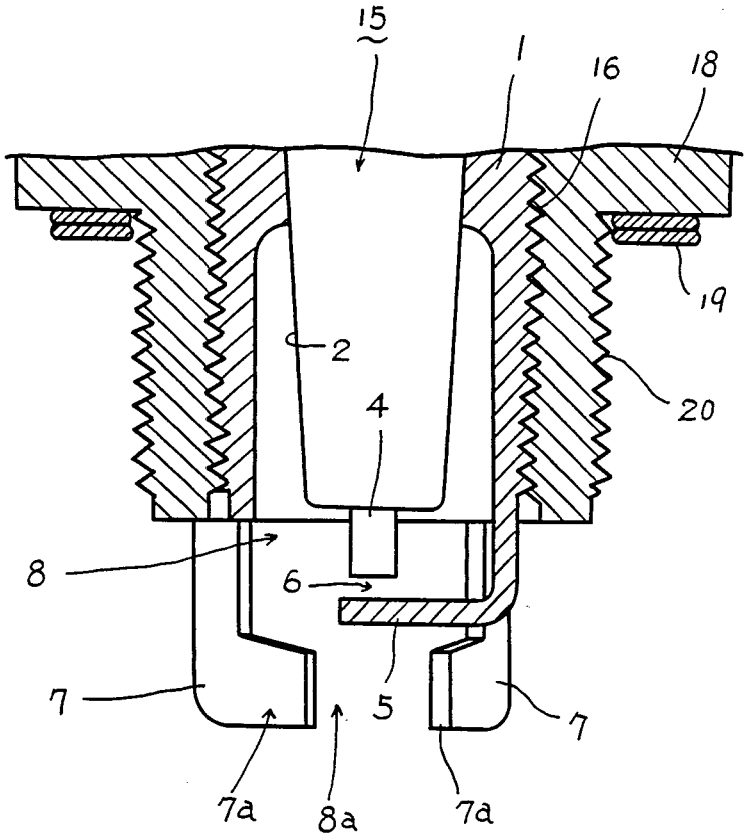
Figure 17:
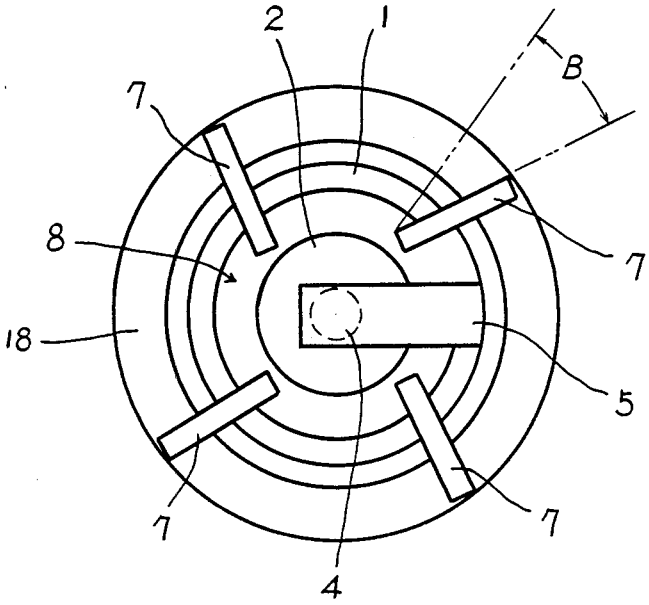

FIGS. 16 and 17 show a modification of the plug in the third example, wherein FIG. 16 is a cross-sectional view of an essential part thereof and FIG. 17 is a bottom view thereof.

Figure 18:
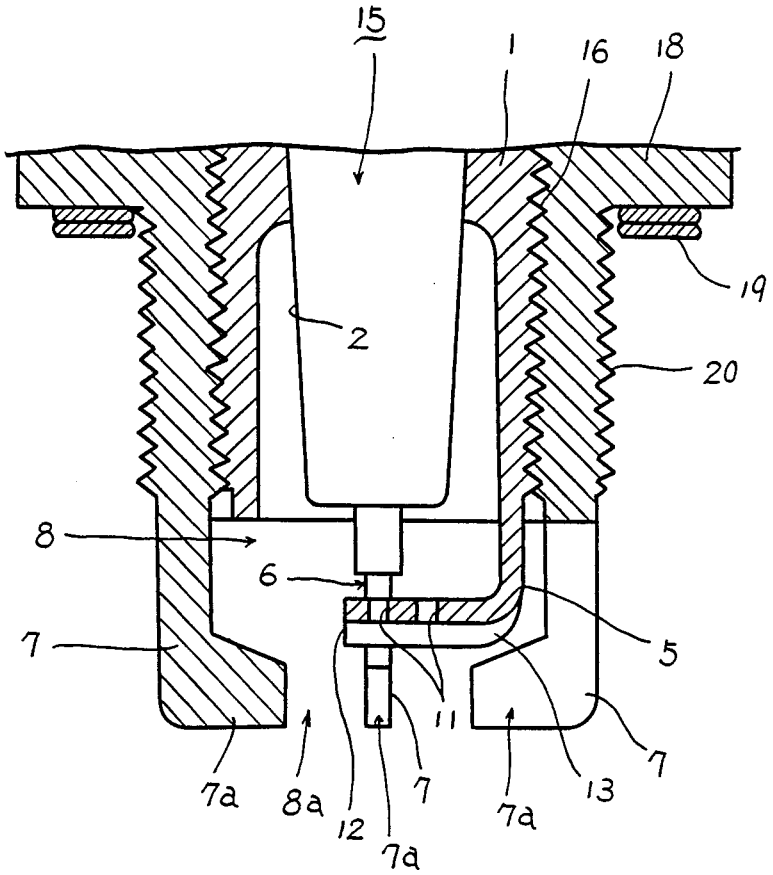
Figure 19:
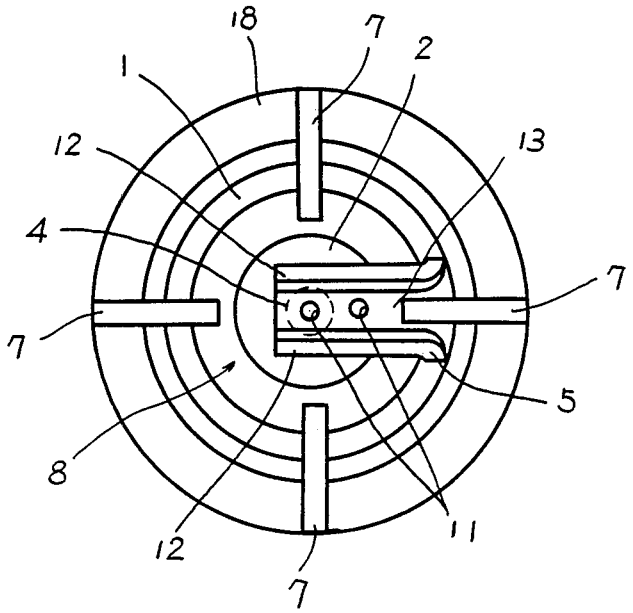

FIGS. 18 and 19 show another modification of the plug in the third example, wherein FIG. 18 is a cross-sectional view of an essential part thereof and FIG. 19 is a bottom view thereof.

Figure 20:
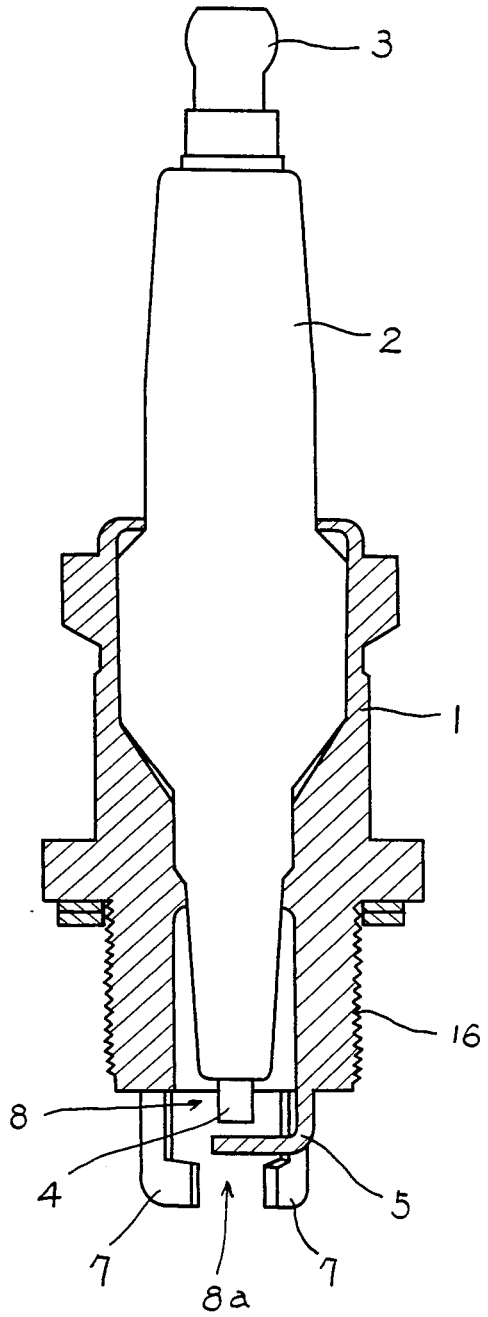
Figure 21:
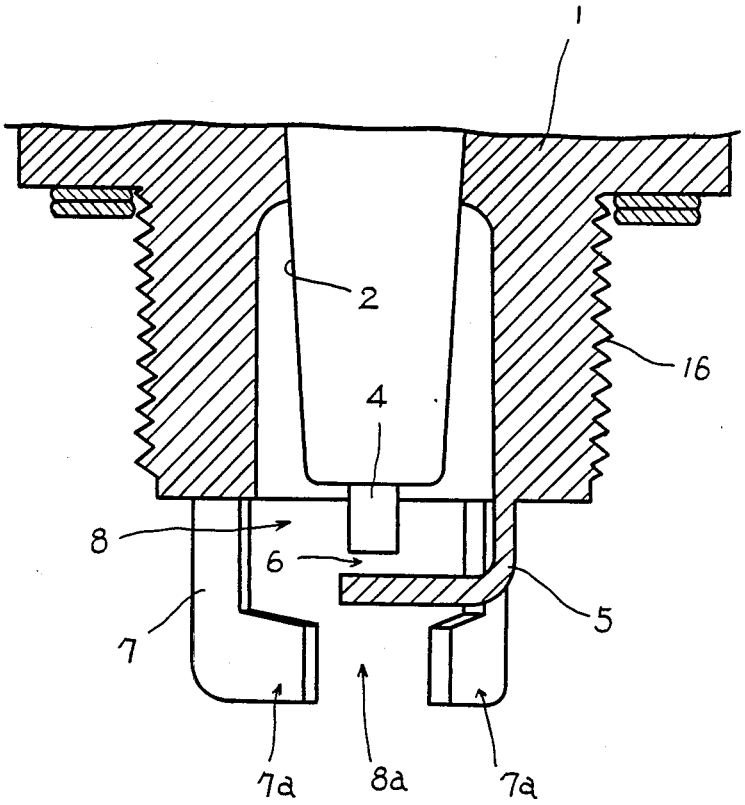
Figure 22:
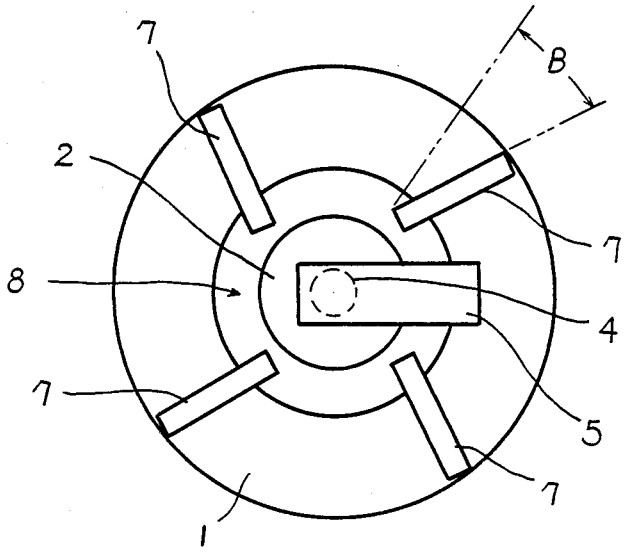

FIGS. 20 to 22 show the fourth example of a plug of this invention, wherein FIG. 20 is a cross-sectional general view thereof, FIG. 21 is a cross-sectional view of an essential part thereof and FIG. 22 is a bottom view thereof.

Now this invention will be described below in detail by way of examples with reference to the accompanying drawings.

Figure 1:
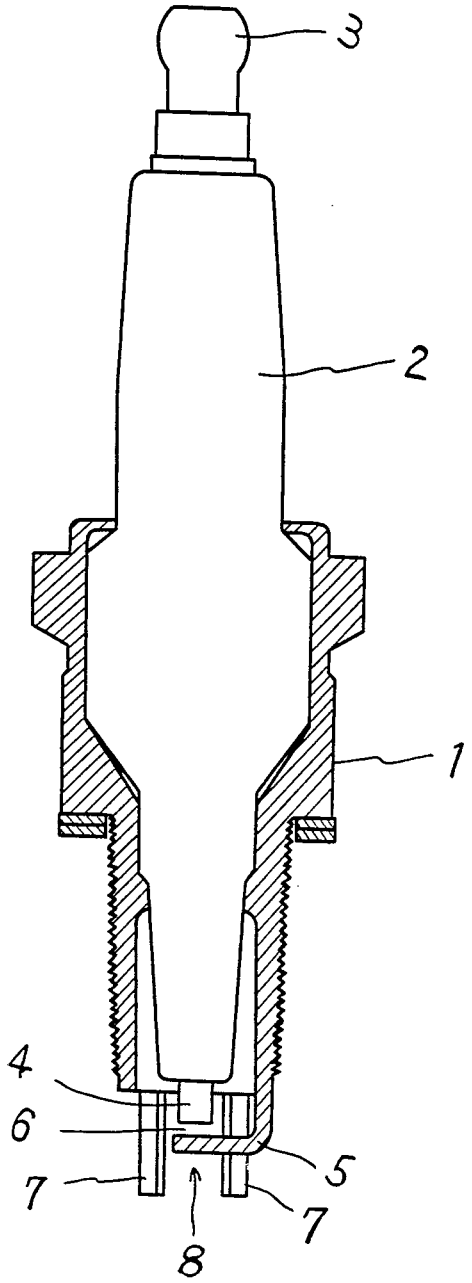
Figure 2:
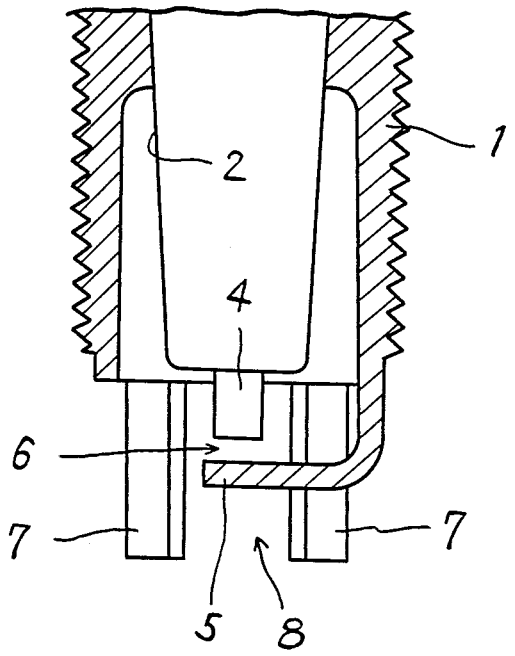
Figure 3:
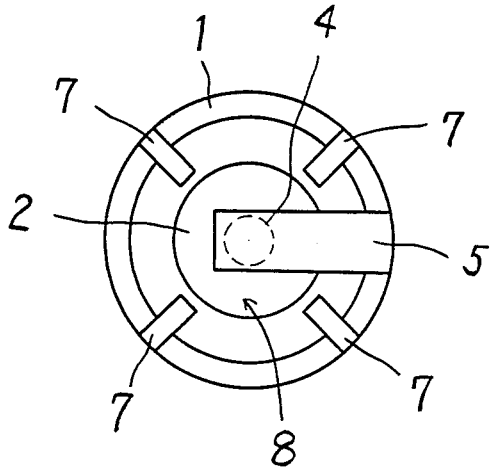

As shown in FIGS. 1 to 3, the ignition plug essentially comprises a grounded electrode 5 fixed on a grounded, externally threaded electroconductive metal cylinder 1 mating with an internally threaded combustion chamber and a center electrode 4 held by an insulating porcelain gasket 2. The grounded electrode is a prism formed into L-shape and fixed on the end brim of the metal cylinder 1 to be introduced in the combustion chamber; its top lies on the axial line of the center electrode 4 and opposes thereto so that a spark gap 6 forms between themselves. A plurality of long, flat and rectangular plates 7, 7 . . . are also fixed on the end brim of the metal cylinder 1 in order that they may be located on the same circumference around the center electrode axis, their long sides extending toward the piston side may be parallel to the same axis so that the spark gap 6 lies almost in their center and, as for their cross-section, the long side thereof may coincide with the radial direction of the center electrode 4 and the short side thereof may face the spark gap 6 in the center, as shown in FIG. 3. As a result of that, each pair of adjacent plates 7, 7 . . . make right angles to each other as far as this example is concerned, whereby the combustion of gas mixture is helped propagate on a plane perpendicular to the center electrode 4 in a great speed.

Such is the structure that when the center electrode 4 is electrified by way of a terminal 3, spark forms between the center and the grounded electrodes, which ignites compressed gas mixture, immediately before the upper dead point of the piston. The explosion follows and this pushes the piston back.

Ignited seeds of gas mixture appear in the space 8 surrounded by the plates 7, 7 . . . by means of spark generated in the spark gap 6. They put gas mixture on fire between the plates outwardly widening their interdistance like fans. Since the volume of the gas mixture between the plates is comparatively small, combustion takes place earlier and combustion gas outwardly expands in the radial direction on the plane perpendicular to the center electrode, which successively ignites the surrounding gas mixture and helps increase the initial combustion speed, shortening the combustion time from ignition to explosion. That is, the structure of the plug is helpful to retard the timing of ignition without retarding the completion of combustion, reduce the energy loss due to the resistance against expanding combustion gas in the progress of piston compression and improve the efficiency of the internal combustion engine so as to minimize the fuel consumption.

In this connection, Table 1 shows a result of a running experiment of cars equipped with an engine with a common plug available in the market and the one equipped with an improved plug shown in this example, wherein the experiment was carried out almost in the same condition.

TABLE 1

| | A. Fuel consumption | B. Covered distance | A/B | Ratio |
|---|---|---|---|---|
| I. Common Plug | 16.5(l) | 115 (km) | 6.96(km/l) | 100(%) |
| II. Improved Plug | 13.1 | 117 | 8.93 | 128 |

Figure 4:
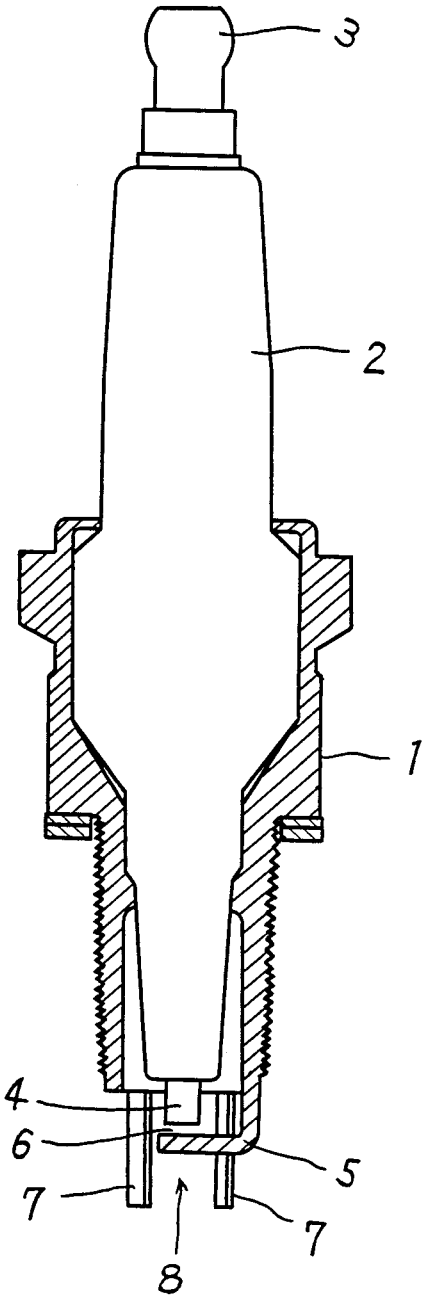
Figure 5:
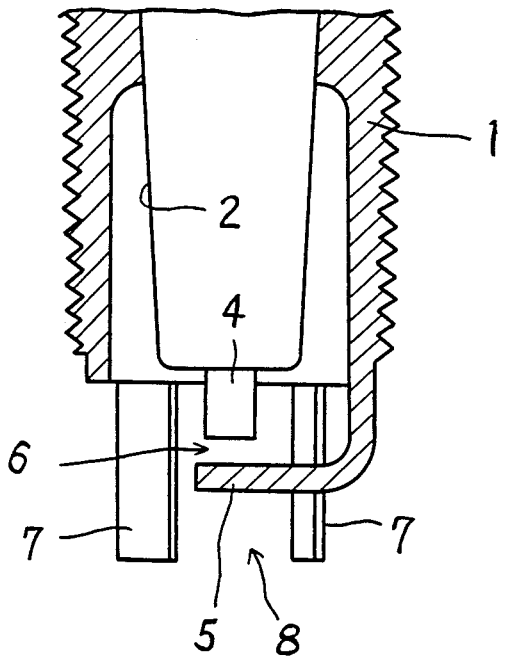
Figure 6:
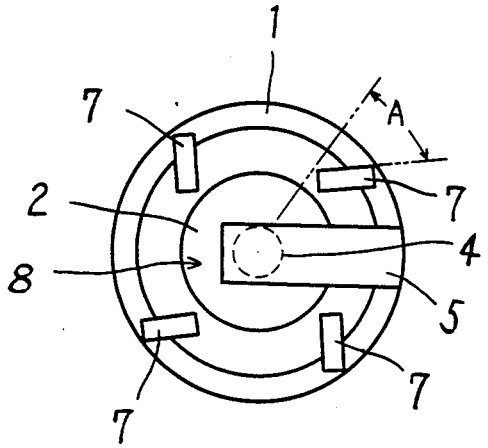

FIGS. 4 to 6 show a modification of the plug in the first example. In FIGS. 1 to 3, the plates 7, 7 . . . are fixed on the end brim of the metal cylinder 1 so that their major flat face is in the radial direction of the center electrode, whereas in this example their major flat face makes an angle (A) of about 45° to the radial direction of the center electrode 4. As soon as there appear ignited seeds of gas mixture in the spark gap 6, they develop into swirling mass of combustion gas and rapidly expands out of the plates 7, 7 . . . causing a turbulent flow by which fresh gas mixture is violently agitated so as to make good combustion uniformly. The plug of this example is aimed at the full utilization of the expanding action of igniting gas mixture for further ignition in the surroundings. Table 2 shows a result of a running experiment of cars equipped with an engine with a common plug available in the market and the one equipped with an improved plug shown in FIGS. 4 to 6, wherein the experiment was carried out almost in the same condition.

TABLE 2

| | A. Fuel consumption | B. Covered distance | A/B | Ratio |
|---|---|---|---|---|
| I. Common Plug | 16.5(l) | 115(km) | 6.96(km/l) | 100(%) |
| II. Improved Plug | 13.7 | 111 | 8.10 | 116 |

Figure 7:
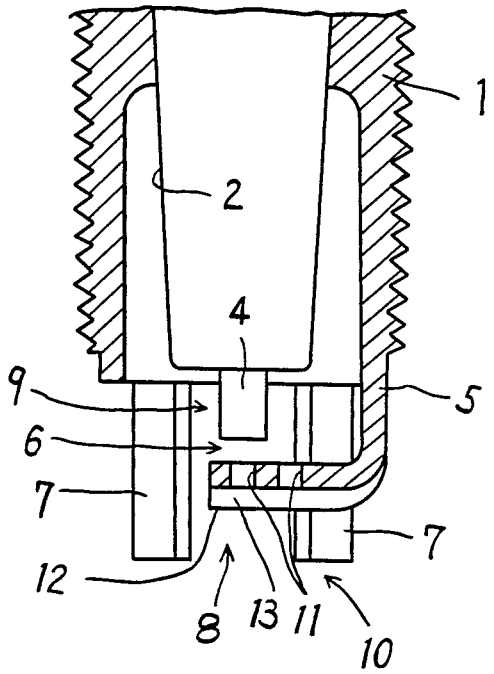
Figure 8:
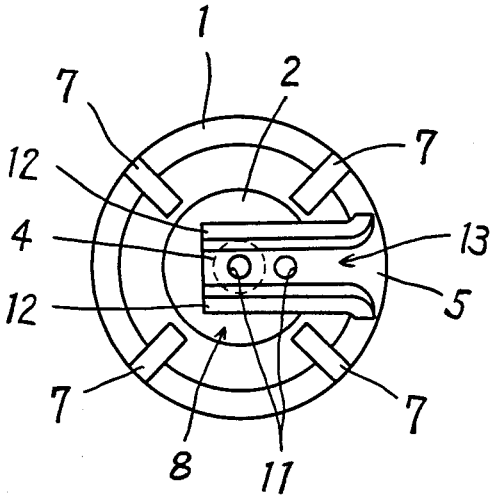
Figure 9:
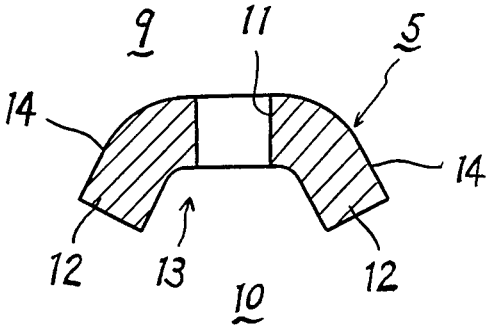

FIGS. 7 to 9 show the second example of a plug of this invention. A plurality of plates 7, 7 . . . are provided to the ignition plug disclosed in Japanese Patent Publication No. 61-30394, in the same way as in FIGS. 1 to 3. An L-shaped grounded electrode 5 has a plurality of holes 11, 11 . . . nearly in the center of its horizontal arm by which the spark side 9 communicates with the piston side 10. The horizontal arm of the grounded electrode 5 is not flat, but bent toward the piston side 10 on both its longitudinal sides 12, 12 as shown in FIG. 9, so that there form a cavity 13 to collect gas mixture thereunder and slopes 14, 14 on both the sides. The grounded electrode 5, whose horizontal arm is made perpendicular to the axial line of the center electrode 4, has a breadth greater than its thickness. The diameter of the holes 11, 11 . . . is smaller than the breadth of the flat portion of the horizontal arm on the upper face. Therefore, ignited seeds of gas mixture ignite more of the gas mixture in the cavity 13 under the grounded electrode by way of the holes 11, 11 . . . , which successively ignites more of the gas mixture on the piston side 10.

In this example, the combustion speed is accelerated not only in the axial direction connecting the center electrode 4 and the piston 10 through the holes 11, 11 . . . but also in the direction perpendicular to the center electrode 4 through the plates 7, 7 . . . once seeds of gas mixture are ignited in the space surrounded by the plates.

Figure 10:
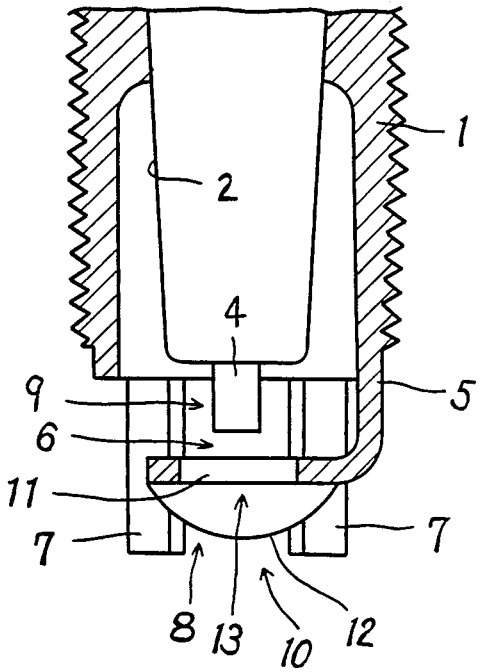
Figure 11:
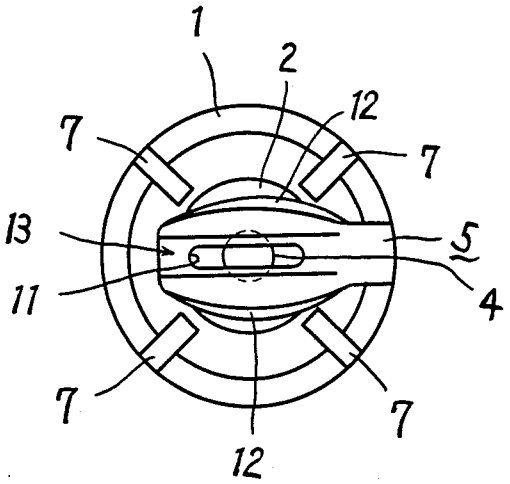
Figure 12:
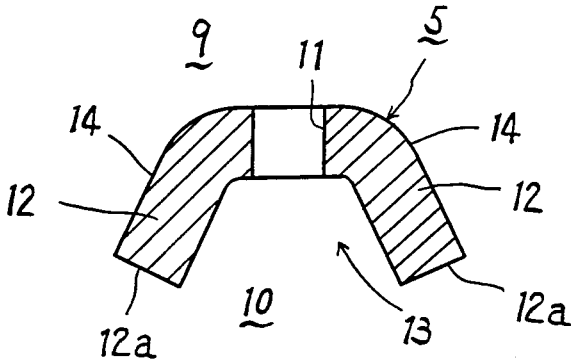

FIGS. 10 to 12 show a modification of the plug in the second example. In this example, a long hole 11 is provided to the grounded electrode 5 in such a way that the longitudinal direction of the hole coincides with the longitudinal direction of the cavity 13 under the grounded electrode. The breadth of the hole 11 is smaller than the diameter of the center electrode 4; besides, the axial line of the center electrode falls on the center of the hole 11. As shown in FIG. 12, the cross-section 12*a* of the slopes 12, 12 on both longitudinal sides of the grounded electrode 5 is made circular, together with their skirt, whereby ignition occuring in the cavity 13 can radially and uniformly propagate toward the piston 10, without giving time lag, on and beneath the slopes 12, 12.

FIGS. 13 to 15 show the third example of a plug of this invention. An electroconductive metal socket 18 is detachably provided to the outside of the metal cylinder 1 by means of right-hand screw with air-tight washers 17 put in between. Left-hand screw 20 is provided to the outside of the socket 18 so that the socket can engage with an engine block by means thereof with air-tight washers 19 put in between. Thus, the ignition plug 15 can be coupled with the block engine by means of the metal cylinder 1 and the socket 18. An L-shaped grounded electrode 5 is fixed on the end brim of the metal cylinder 1 in one piece and a plurality of plates 7, 7 . . . are fixed on the end brim of the socket 18 in one piece at an equal interval; hence, spark gap is located almost in the middle of the ignition space 8 surrounded by the plates. All of the plates 7, 7 . . . are formed into L-shape, the first vertical arm of which is almost parallel to the center electrode and the second horizontal arm of which inwardly projects 7*a* in an opening 8*a* on the piston side 10. As for the rectangular cross-section of the plates, the long side thereof is laid in the radial direction of the center electrode 4 and the short side thereof faces the spark gap 6. In consequence, the central essential part of the plug is divided into four small segments by the four plates 7, 7 . . . as far as this example is concerned.

The ignition speed of ga mixture in the transversal direction is accelerated by the combustion gas passing through the first vertical portion 7 and that in the axial direction is accelerated by the combustion gas passing through the second horizontal portion 7*a* of the L-shaped plates, both of which contribute to the great reduction of time from ignition to explosion.

Since the socket 18 with the plates 7, 7 . . . is manufactured separately from the plug, their size and shape can be changed at will according to the piston displacement of an engine or the shape inside the combustion chamber. That is, in order to give an ignition plug the best performance, morphologically different types of plates fixed to the socket 18 in one piece can be interchangeably mounted to the plug one after another until the best choice is obtained.

FIGS. 16 and 17 show a modification of the plug in the third example. The plates 7, 7 . . . are fixed radially on the end brim of the socket 18 in FIGS. 13 to 15, whereas they are fixed on the end brim of the socket at an angle (B) of about 30° to the radical direction thereof around the center electrode 4 in this example, as shown in FIG. 17.

No sooner do ignited seeds of gas mixture appear in the space 8 within the plates 7, 7 . . . than they develop into a swirling mass of combustion gas. At this moment, the plates 7, 7 . . . inclined to the radial direction serve to successively and effectively mix fresh gas mixture in the surrounding with the combustion gas by a turbulent flow caused by the explosion of the combustion gas.

FIGS. 18 and 19 show another modification of the plug in the third example. Like in FIGS. 7 to 9, an L-shaped grounded electrode 5 provided with a plurality of holes 11, 11 . . . on the horizontal arm and a cavity 13 for collecting gas mixture under that arm is fixed to the metal cylinder 1 in one piece. As a matter of course, the socket 18 shown in FIGS. 13 to 15 and FIGS. 16 and 17 can be interchangeably mounted on any plugs shown in FIGS. 13 to 15 and FIGS. 18 and 19, if necessary. Moreover, such sockets 18 can be mounted on a plug with structurally different type of grounded electrodes, such as shown in FIGS. 10 to 12.

Like this, different types of grounded electrodes 5 can be used in combination with different types of sockets and plates.

FIGS. 20 to 22 show the fourth example of a plug of this invention, wherein the metal cylinder with right-hand thread is greater than those in FIGS. 13 to 15, 16 and 17, and 18 and 19 in diameter to such extent that sockets 18 such as shown in FIGS. 13 to 15 are omissible. Thus, compared with the first example, the metal cylinder 1 is provided with such a larger face at its end brim that it can be provided with larger plates 7, 7 . . . , such as shown in FIGS. 16 and 17. These types of plugs can be used for an internal combustion engine with great piston displacement.

We claim:

1. A spark plug adapted for use in an internal combustion engine comprising;

(a) a housing having means to attach to an internal combustion engine;

(b) insulator means disposed within the housing;

(c) a high tension electrode axially disposed within the insulator means and insulated form the housing;

(d) a substantially L-shaped ground electrode having a first leg depending axially from the housing and a second leg having its free end extending radially inward and spaced axially from the first electrode;

(e) a plurality of equally spaced apart rectilinear combustion flame deflecting plates extending axially from the housing and disposed generally parallel to said high tension electrode and disposed radially about the first electrode to define a combustion chamber, said plates having an axial length greater than the width.

2. The spark plug of claim 1 wherein each of the plates are disposed in a plane extending radially outward from the high tension electrode whereby combustion gas upon ignition in said combustion chamber is directed radially outward.

3. The spark plug of claim 1 wherein the plates are disposed in a plane angled from the radial direction from the high tension electrode whereby combustion gas upon ignition in said combustion chamber is directed spirally outward.

4. The spark plug of claim 3 wherein the plates are disposed at an angle of about 45° to the radial direction from the high tension electrode.

5. The spark plug of claim 1 wherein the plates have an axial length greater than the length of the high tension electrode whereby the plates extend axially beyond the high tension electrode.

6. The spark plug of claim 1 wherein the plates have a substantially L-shape comprising a first leg extending axially from the housing and a second leg having a free end extending inwardly toward the high tension electrode.

7. The spark plug of claim 6 wherein the end of the second leg is axially and radially spaced from the high tension electrode.

8. The spark plug of claim 6 wherein the L-shaped plates are disposed in a plane extending radially outward from the high tension electrode whereby combustion gas upon ignition in said combustion chamber is directed radially outward.

9. The spark plug of claim 6 wherein the L-shaped plates are disposed in a plane angled from the radial direction from the high tension electrode whereby combustion gas upon ignition in said combustion chamber is directed spirally outward.

10. The spark plug of claim 9 wherein the L-shaped plates are disposed at an angle of about 30° to the radial direction from the high tension electrode.

11. The spark plug of claim 1 wherein the second leg of the ground electrode has a substantially U-shaped cross-section defined by a top portion and depending longitudinal sides extending axially away from the high tension electrode, said longitudinal sides defining a combustion cavity for a fuel mixture, said top portion having at least one aperture to communicate with the combustion cavity.

12. The spark plug of claim 11 wherein the aperture is circular.

13. The spark plug of claim 12 wherein two spaced apart apertures are provided.

14. The spark plug of claim 11 wherein the aperture is a longitudinal slit having a width less than the diameter of the high tension electrode and a longitudinal length greater than the diameter of the high tension electrode.

15. The spark plug of claim 11 wherein the longitudinal sides are substantially semi-circular.

16. The spark plug of claim 1 wherein four deflecting plates are provided.

17. A spark plug adapted for use in an internal combustion engine comprising;

(a) a housing;

(b) electrical insulator means axially disposed within the housing;

(c) a high tension electrode axially disposed within the insulator means and insulated from the housing;

(d) a substantially L-shaped ground electrode having a first leg depending axially from the housing and a second leg extending radially inward and spaced axially from the first electrode;

(e) a removable annular sleeve receiving the housing and adapted to be mounted in an internal combustion engine;

(f) a plurality of equally spaced apart rectilinear combustion flame deflecting plates extending axially from the annual sleeve and disposed generally parallel to said high tension electrode and disposed radially about the high tension electrode, said plates having a first leg extending axially from the sleeve and a second leg extending inwardly toward the high tension electrode, said plates being disposed to define a combustion chamber.

18. The spark plug of claim 17 wherein the L-shaped plates are disposed in a plane extending radially outward from the high tension electrode whereby combustion gas upon ignition in said combustion chamber is directed radially outward.

19. The spark plug of claim 17 wherein the L-shaped plates are disposed in a plane angled from the radial direction from the first electrode whereby combustion gas upon ignition in said combustion chamber is directed spirally outward.

20. The spark plug of claim 19 wherein the L-shaped plates are disposed at an angle of about 30° to the radial direction from the high tension electrode.

21. The spark plug of claim 17 wherein the second leg of the ground electrode has a substantially U-shaped cross-section defined by a top portion and depending longitudinal sides extending axially away from the high tension electrode, said longitudinal sides defining a combustion cavity for a fuel mixture, said top portion having at least one aperture to communicate with the combustion cavity.

22. The spark plug of claim 21 wherein the aperture is circular.

23. The spark plug of claim 22 wherein two spaced apart apertures are provided.

24. The spark plug of claim 21 wherein the aperture is a longitudinal slit having a width less than the diameter of the high tension electrode and a longitudinal length greater than the diameter of the high tension electrode.

25. The spark plug of claim 21 wherein the longitudinal sides are substantially semi-circular.

26. The spark plug of claim 17 wherein four deflector plates are provided.

27. The spark plug of claim 17 wherein the housing includes external threads and the sleeve includes internal threads to receive the housing.

28. A combustion flame deflecting device adapted for use with a spark plug in combination with an internal combustion engine, the spark plug being of the type comprising a threaded housing, insulator means disposed within the housing, an axially disposed high tension electrode and a substantially L-shaped ground electrode cooperating with the high tension electrode, said deflecting device comprising an internally threaded sleeve adapted to receive a threaded spark plug, the sleeve further having external threads for mounting the sleeve in an internal combustion engine, a plurality of equally spaced apart combustion flame deflecting plates extending axially from the annular sleeve, wherein said plates have a first leg extending axially from and generally parallel to the sleeve and a second leg extending radially inwardly toward the center of said sleeve to define a combustion chamber.

29. The spark plug of claim 28 wherein the L-shaped plates are disposed in a plane extending radially outward from the sleeve whereby combustion gas upon ignition in said combustion chamber is directed radially outward.

30. The spark plug of claim 28 wherein the L-shaped plates are disposed in a plane angled from the radial direction of the sleeve whereby combustion gas upon ignition in said combustion chamber is directed spirally outward.

31. The spark plug of claim 30 wherein the L-shaped plates are disposed at an angle of about 30° to the radial direction of the sleeve.

* * * * *